US005676378A

United States Patent [19]

West

[11] Patent Number: 5,676,378

[45] Date of Patent: Oct. 14, 1997

[54] IMPROVED FIREARM TARGET APPARATUS

[76] Inventor: Daniel L. West, P.O. Box 1261, San Marcos, Tex. 78667

[21] Appl. No.: 635,631

[22] Filed: Apr. 22, 1996

[51] Int. Cl.[6] ..... F41J 5/18

[52] U.S. Cl. ..... 273/390; 273/404; 273/403; 273/406; 273/407

[58] Field of Search ..... 273/390–392, 273/406, 407, 403, 404

[56] References Cited

U.S. PATENT DOCUMENTS

| | | | |
|---|---|---|---|
| 1,087,507 | 2/1914 | Palen | 273/391 |
| 2,069,822 | 2/1937 | Douglas | 273/404 |
| 2,130,558 | 9/1938 | Murray | 273/390 |
| 4,614,345 | 9/1986 | Doughty | 273/392 |
| 4,691,925 | 9/1987 | Scholem . | |
| 5,232,227 | 8/1993 | Bateman . | |
| 5,240,258 | 8/1993 | Bateman . | |
| 5,242,172 | 9/1993 | Bateman . | |
| 5,263,721 | 11/1993 | Lowrance | 273/390 |

FOREIGN PATENT DOCUMENTS

| | | | |
|---|---|---|---|
| 218522 | 1/1968 | Sweden | 273/406 |

*Primary Examiner*—Mark S. Graham
*Attorney, Agent, or Firm*—Henderson & Sturm

[57] ABSTRACT

An improved firearm target apparatus (10), including a base member (20) for pivotally supporting an elongated target support member (30) having a pair of support arms (39) for supporting a target body member (50); wherein, the base member (20) is provided with an adjusting unit (14) for varying the vertical orientation of the support member relative to a portion (24) of the base member (20).

18 Claims, 3 Drawing Sheets

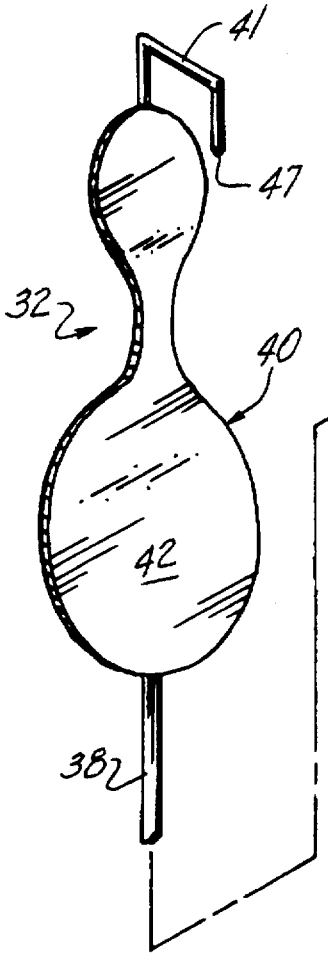
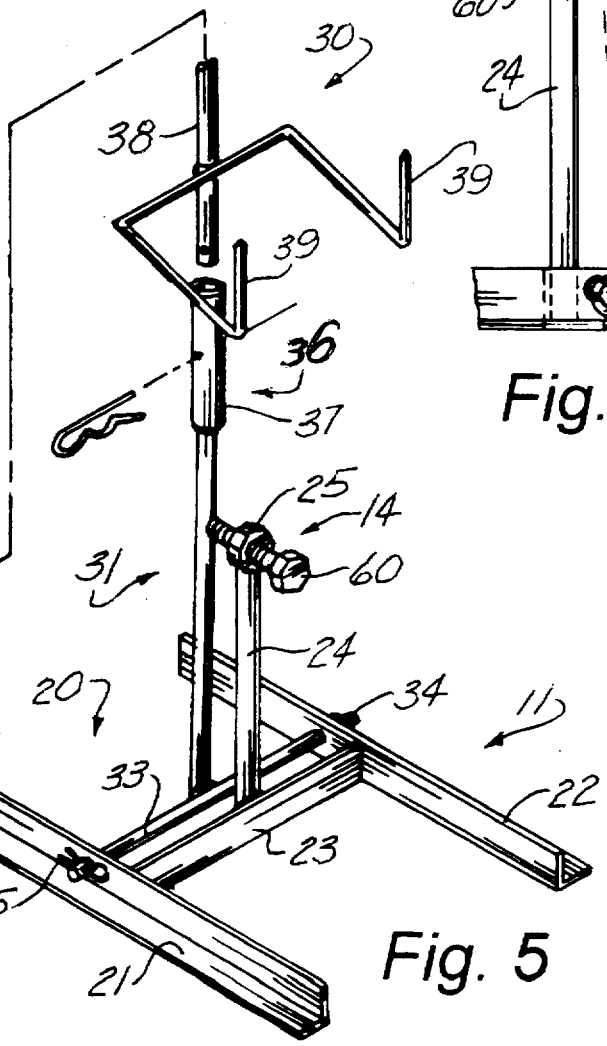
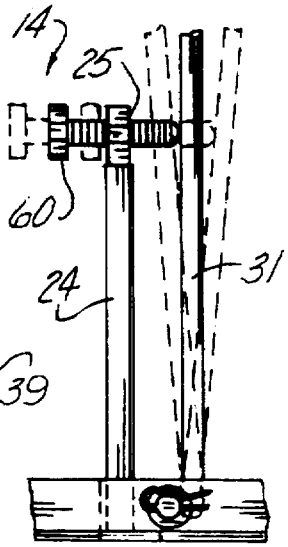
Fig. 6
Fig. 5
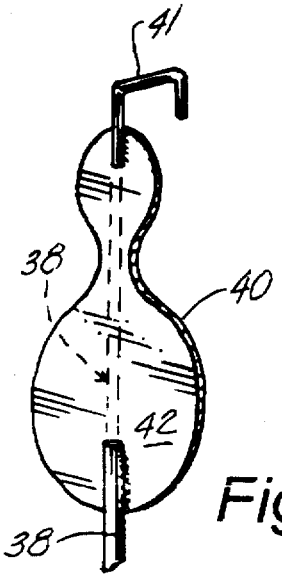
Fig. 7

IMPROVED FIREARM TARGET APPARATUS

TECHNICAL FIELD

The present invention relates to the field of firearm target devices in general, and in particular to an improved target body and pivoted target body support apparatus.

BACKGROUND ART

As can be seen by reference to the following U.S. Pat. Nos. 4,691,925; 5,240,258; 5,242,172; and 5,232,227 the prior art is replete with myriad and diverse firearm target devices.

While all of the aforementioned prior art constructions are more than adequate for the basic purpose and function for which they have been specifically designed, they are also uniformly remiss in their failure to provide an interaction target apparatus wherein the target body and its related support apparatus cooperate with one another to prolong the useful life of the target body by minimizing the deleterious effects of ricochets from the support apparatus In addition, the prior art constructions are completely silent with regard to incorporating a biasing system into the target support apparatus so that a rapid succession of accurate shots are required in order to knock down the target.

As a consequence of the foregoing situation, there has existed a longstanding need for an improved firearm target apparatus which combines an improved target body with a biasable target support in a single apparatus; wherein, the target body and the target support apparatus are unique not only by themselves but also in combination with an another and the provision of such a construction is a stated objective of the present invention.

DISCLOSURE OF THE INVENTION

This invention was the subject matter of Disclosure Document No. 392,992 filed on Feb. 29, 1996, which is incorporated herein by reference.

Briefly stated, the improved firearm target apparatus that forms the basis of the present invention comprises in general a target body unit, a base unit, a target support unit and a biasing unit.

The target support unit has a lower end which is pivotally secured to the base unit and an upper end which operatively engages the target body unit. In addition, the biasing unit operatively engages the upper portion of the base unit with the intermediate portion of the target support unit.

As will be explained in greater detail below, the improved firearm target apparatus of this invention has many novel features incorporated herein to wit: a unique long-lasting target body configuration that essentially doubles the useful life of the target body unit; a unique cooperation between the target body unit and the target support unit which both provides an added safety factor for the shooter, and which minimizes the deleterious effects of ricochets on the target body unit; and, an adjustable biasing system deployed between the base unit and the pivoted target support unit that will allow the target support unit and target body unit to be adjustable so it can be incrementally and visibly displaced relative to the base unit with a single shot, yet adjustable to require a rapid succession of accurate shots to "knock down" the target support unit and related target body unit.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 5 is a partial exploded perspective view of the base unit, target support unit and the biasing unit;

FIG. 6 is an isolated, detail view of the biasing unit;

FIG. 7 is an isolated, detail view of the preferred kill zone configuration;

BEST MODE FOR CARRYING OUT THE INVENTION

Figure 1:
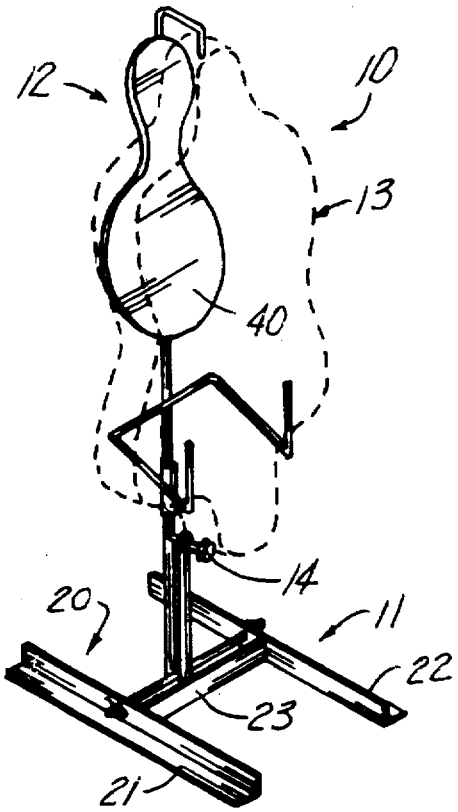
FIG. 1 is a perspective view of the improved firearm target apparatus that forms the basis of the present invention with the target body unit shown in phantom.

As can be seen by reference to the drawings, and in particular FIG. 1, the improved firearm target apparatus that forms the basis of the present invention is designated generally by the reference numeral (10). The apparatus (10) comprises in general: a base unit (11), a target support unit (12), a target body unit (13) and a biasing or adjusting unit (14). These units will now be described in serialism fashion.

As can best be seen by reference to FIGS. 1 and 5, the base unit (11) comprises a generally H-shaped base member (20) having a pair of horizontally disposed support legs (21) (22) connected to one another proximate their midpoints by a horizontally disposed cross-piece element (23). In addition, the base member (20) is further provided with a stationary vertical post element (24) which is connected to and projects upwardly from the midpoint of the cross-piece (23); wherein, the upper end of the stationary vertical support post (24) is provided with a threaded aperture (25) whose purpose and function will be described further on in the specification.

As shown in FIGS. 5 thru 8, the target support unit (12) comprises an elongated support member (30) having a generally inverted T-shaped lower section (31) which is pivotally secured to the horizontally disposed support legs (21) (22) proximate the cross-piece element (23) and an elongated upper section (32) which is releasably connected to the lower section (31) as will be explained presently.

Referring specifically to FIG. 5, it can be seen that cross-arm (33) with enlarged head (34) thereon of the inverted T-shaped lower section (31) project through suitably dimensioned apertures in the support legs (21) (22) and are pivotally retained therein by a cotter pin (35), or the like. In addition the upper end of the stem (36) of the lower section (31) of the support member (30) is provided with a generally cylindrical connector element (37) which is dimensioned to captively receive the upper section (32) of the support member (30) in a well-organized fashion.

Still referring to FIG. 5, it can be seen that the upper section (32) of the support member (30) comprises an elongated support pole (38) provided with a pair of generally L-shaped support arms (39) which project outwardly from the lower portion of the upper section (32); wherein, the upper portion of the upper section (32) is fixedly secured to a contoured "kill zone" impact plate element (40).

In addition, the upper end of the impact plate element (40) is further provided with a generally inverted J-shaped target capture element (41). It should also be noted at this juncture that, while in the preferred embodiment of the invention depicted in FIGS. 2, 4, 5 and 7, the target capture element (41) is a distinct structural component affixed to the upper end of the impact plate element (40), the target capture element (41) may also be formed by an extension of the elongated support pole (38) as depicted in phantom in FIG. 7.

Figure 8:
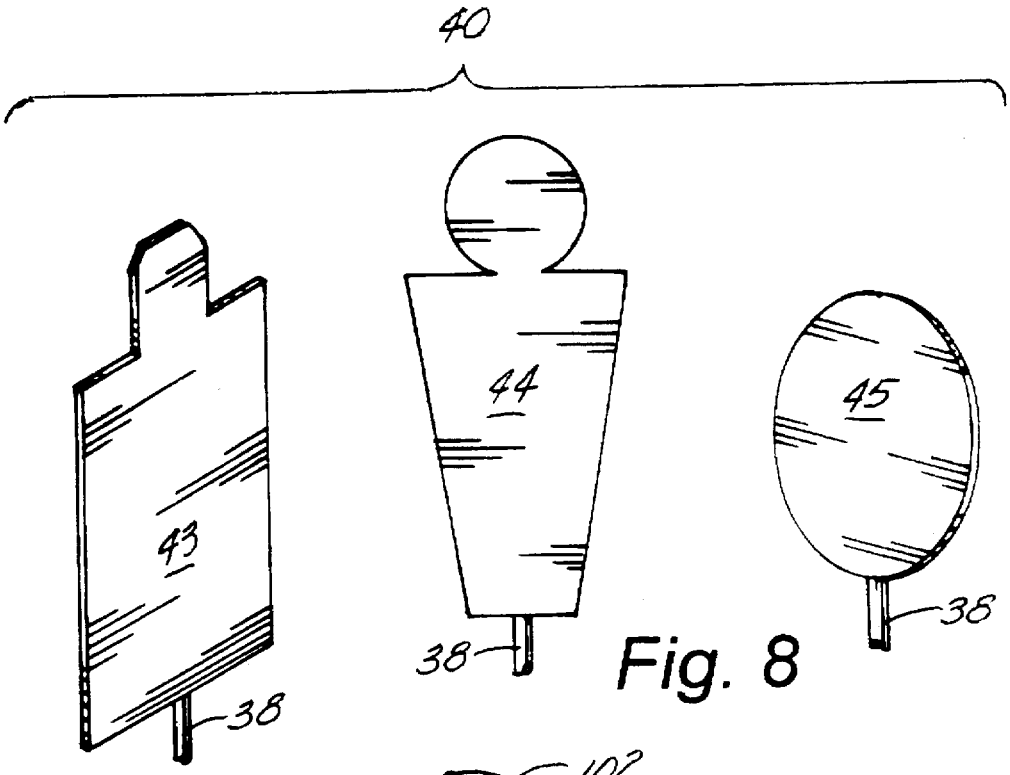
FIG. 8 is a perspective view of alternate kill zone configurations.

In the preferred embodiment of the invention depicted in FIGS. 5 and 7, the plate element (40) is provided with a generally bowling pin configuration (42). However, as shown in FIG. 8, this invention also contemplates a generally stacked rectangular configuration (43), a circle and trapezoid configuration (44), a circular configuration (45), and many other configurations which those familiar with this art may believe is appropriate.

Figure 3:
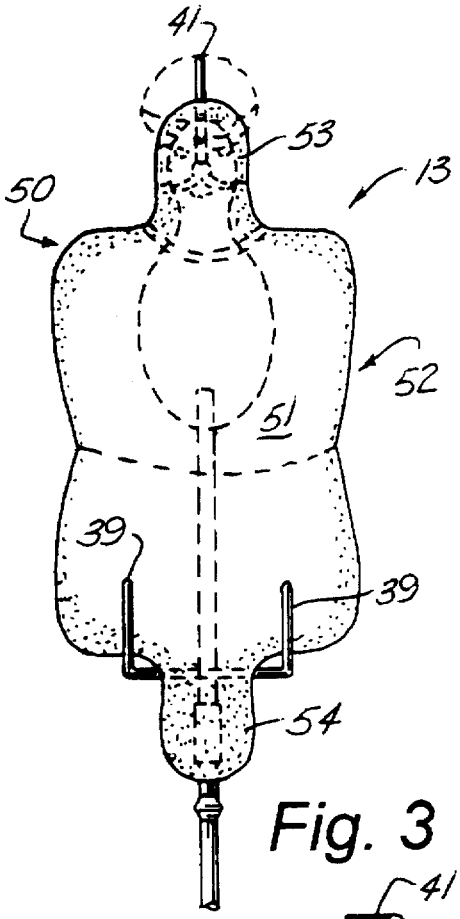
FIG. 3 is a from elevation view of the target body unit and the upper portion of the target support unit.
Figure 4:
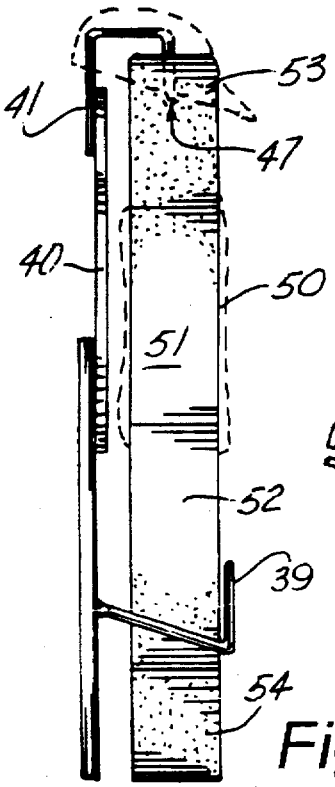
FIG. 4 is a side elevation view of the target body unit and the upper portion of the target support unit.

As can best be seen by reference to FIGS. 3 and 4, the target body unit (13) comprises an enlarged contoured target body member (50) fabricated from a thick sheet of dense yet flexible foam material; wherein, the torso portion (52) of the body member (50) has a generally enlarged hourglass configuration; and, the upper and lower ends of the body member (50) are provided with head portions (53)(54) such that the top and bottom halves of the body member (50) are mirror images of one another.

Still referring to FIGS. 3 and 4, it can be seen that the target body member (50) is dimensioned and contoured such that the lower head portion (54) will be received between the spaced support arms (39) which project outwardly from the upper section (32) of the support member (30); whereas, the upper head portion (53) will be penetratingly engaged by the outboard tip (47) of the target capture element (41).

Figure 2:
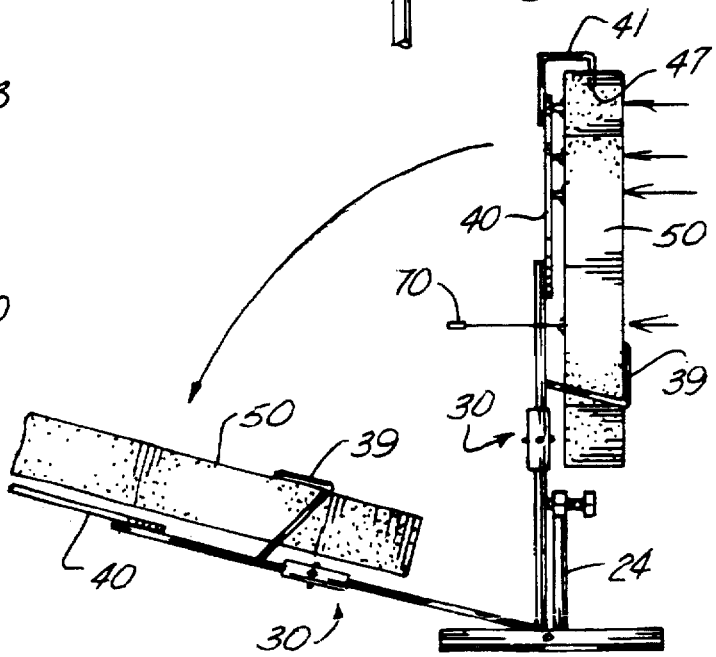
FIG. 2 is a side elevation view of the apparatus in its upright and knocked down orientations.

In addition, as can best be seen by reference to FIGS. 2 and 4, the rear surface of the target body member (50) is maintained by both the support arms (39) and the outboard tips (47) of the target capture element (41 ), at a spaced location from the front face of the "kill zone" impact plate element (40). Furthermore, this spacing serves a dual function in that it enhances the useful life of the target body member (50) by minimizing the deleterious effects of ricochets on the rear surface of the body member (50); while also providing an added safety factor from ricochets to a shooter who is positioned in close proximity to the apparatus (10).

Turning now to FIGS. 5 and 6, it can be seen that the biasing unit (14) comprises an elongated threaded adjusting or biasing member (60), which is dimensioned to be secured in the threaded aperture (25) in the upper end of the stationary vertical support post (24); whereby, the adjusting member (60) can be brought into engagement with the lower section (31) of the target support member (30) to vary the angular orientation of the target support member (30) with respect to base member (20). The more the target is tipped forward from vertical toward member (20), the more force will be required to tip it over to the lowered position shown in FIG. 2.

In as much as the apparatus (10) of this invention is primarily designed and intended for use at outdoor firing ranges, the adjusting member (60) may be employed to maintain the target support member (30) and associated target body member (50) in a perfectly stable vertical orientation. It can be adjusted by member (60) to compensate for various wind conditions and various shot size or caliber conditions.

However, there are other situations wherein due to the limited mass and velocity of small caliber bullets, the impact produced by those rounds are insufficient to overcome the inertia of the pivoted support member (30) and target body (50). In these instances, the adjusting member (60) is moved to the fight as viewed in FIG. 6, to destabilize the pivoted support member (30), such that the impact produced by a lighter round will "knock down" the support member (30) and target body member (50).

Of more importance, however, is the ability of the adjusting member (60) to overstabilize the support member (30) and target body member (50) by moving the adjusting member (60) to the left as viewed in FIG. 6. This overstabilization feature insures that two or more accurate shots in rapid succession are required to impact the "kill zone" plate element (40) to produce a "knock down"; wherein, the first accurate shot moves the support member (30) from the overstabilized position to the stable position, and before the support member (30) has the time to return to the overstabilized position the succeeding accurate shot or shots moves the support member (30) to the totally destabilized position.

It should also be noted at this juncture that when the support member (30) is placed in the overstabilized position, a single accurate shot or a plurality of shots at wider spaced intervals of time will not be sufficient to "knock down" the support member (30). However, they will cause the support member (30) and target body member (50) to visibly move or "bob" as the support member (30) is moved away, and returned to, the overstabilized position by the shots.

In this way the shooter is provided with both visual and audible indications of a killing shot, without the need for the target body member (50) and the support member (30) to be physically knocked down.

Figure 9:
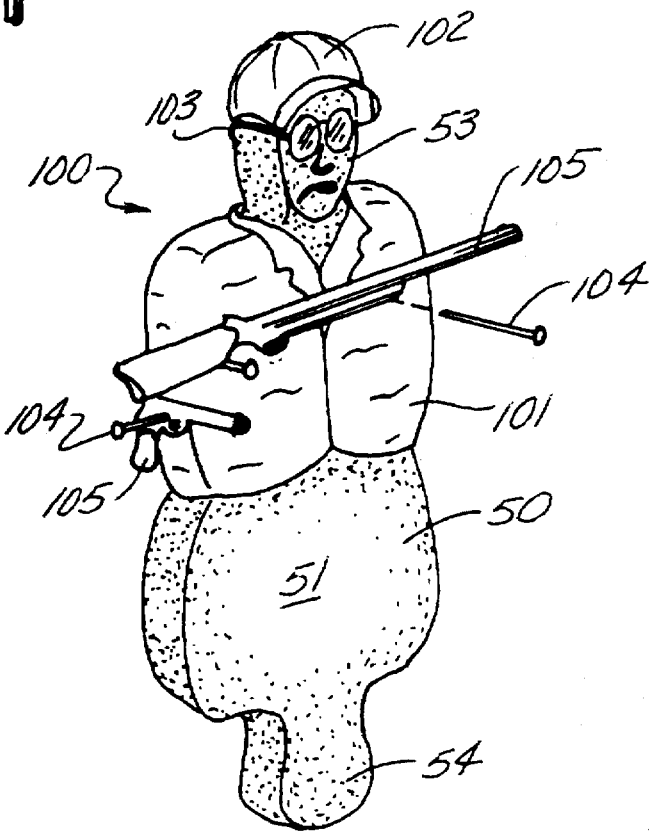
FIG. 9 is an isolated, perspective view of an accessorized target body unit.

In closing, it should also be mentioned that as shown in FIG. 9, each of the mirror image halves of the target body member (50) have a generally human upper torso configuration that not only allows the target body members (50) to be provided with accessories (100) such as clothing (101), hats (102), eyeglasses (103), and the like; but, the dense foam material (51) of the target body member (50) may also be penetratingly engaged by pointed dowels (104) to provide support for simulated firearms (105).

In addition, the target body member (50) is susceptible to imprinting by a marking implement (not shown) for simulating facial features on the target body member (50). Given the mirror image configurations of the upper and lower halves of the target member (50), once the upper half of the target member (50) is "shot out", the target member (50) is inverted so that the lower half of the target member (50) assumes the original position of the upper half to essentially provide the shooter with a fresh target surface that covers the "kill zone" plate element (40). The arrows in FIG. 2 show how a bullet (70) passes through target member (50) without causing the target to tip but rounds which hit plate (40) cause a tipping force.

Having thereby described the subject matter of the present invention, it should be apparent that many substitutions, modifications and variations of the invention are possible in light of the above teachings. It is, therefore to be understood that the invention as taught and described herein is only to be limited to the extend of the breadth and scope of the appended claims.

I claim:

1. An improved firearm target apparatus comprising:

a base member having a vertically projecting support post;

a target body unit; comprising an enlarged target body member; wherein, the upper and lower halves of the target body member are mirror images of one another; and, wherein each half has an upper torso portion and a head portion;

a target support unit including an elongated target support member having a lower section pivotally secured to and disposed proximate to said base member and an upper section provided with an enlarged impact plate element;

a support associated with the upper section of said target support member for securing said target body unit thereto; and an adjusting mechanism operatively associated with the elongated target support member and the vertically projecting support post for varying the distance between said support member and said support post.

2. The apparatus as in claim 1; wherein, the support includes:

a pair of support arms projecting outwardly from the upper section of the support member and dimensioned to receive a first portion of the target body unit.

3. The apparatus as in claim 2; wherein, the support further includes:

a target capture element disposed on the upper portion of the impact plate element and dimensioned to engage a second portion of the target body unit.

4. The apparatus as in claim 3; wherein, said pair of support arms and said target capture element captively engage the target body unit at a location spaced from the impact plate element.

5. The apparatus as in claim 1; wherein, the adjusting mechanism comprises:

an elongated biasing member threadably engaged with the support post in the base member; wherein, one end of the biasing member is aligned with and dimensioned to engage the lower section of the support member to vary the distance between the support member and the support post.

6. The apparatus of claim 3; wherein, the pair of support arms engage the lower half of the target body member on opposite sides of the lower head portion.

7. The apparatus as in claim 6; wherein, the target capture element engages the upper half of the target body member on the upper head portion.

8. The apparatus as in claim 7; wherein, an outer end of the target capture element penetratingly engages the upper head portion.

9. The apparatus as in claim 1; wherein, the upper section and the lower section of the target support member are releasably connected to one another.

10. The apparatus as in claim 1; wherein, the base member includes:

a pair of elongated support legs connected to one another by a cross-piece element in a generally H-shaped configuration.

11. The apparatus as in claim 10; wherein, the vertically projecting support post is rigidly secured proximate to the mid-point of the cross-piece element.

12. An improved firearm target apparatus comprising:

a base member having a vertically projecting support post; and including a pair of elongated support legs connected to one another by a cross-piece element in a generally H-shaped configuration wherein, the vertically projecting support post is rigidly secured proximate to the mid-point of the cross-piece element; a target support unit including an elongated target support having a lower section pivotally secured to and disposed proximate to said base member and an upper section provided with an enlarged impact plate element wherein, the lower section of the support member has an inverted T-shaped configuration; wherein, cross-arms of the lower section are pivotally secured in the support legs of the base member;

a target body unit;

a support associated with the upper section of said target support member for securing said target body unit thereto; and an adjusting mechanism operatively associated with the elongated target support member and the vertically projecting support post for varying the distance between said support member and said support post.

13. An improved firearm target apparatus comprising:

a base member having a vertically projecting support post;

a target body unit comprising an enlarged target body member representative of at least the upper torso of a human target;

a target support unit including an elongated target support member having a lower section pivotally secured to and disposed proximate to said base member and an upper section provided with an impact plate element representative of the vital kill zone of a human target;

a support associated with the upper section of said target support member for securing said target body unit thereto; and an adjusting mechanism operatively associated with the elongated target support member and the vertically projecting support post for varying the distance between said support member and said support post.

14. The apparatus as in claim 13; wherein, the upper and lower halves of the target body member are mirror images of one another; and, wherein each half has an upper torso portion and a head portion.

15. The apparatus as in claim 13; wherein, the impact plate element has a generally circular configuration.

16. The apparatus as in claim 13; wherein, the impact plate element has a generally rectangular configuration.

17. The apparatus as in claim 14; wherein, the impact plate element is dimensional and configured to be covered by both the upper torso portion and the head portion of each half of said target body member.

18. The apparatus as in claim 13; wherein, the target body member is disposed on the target support member in a spaced relationship relative to the impact plate element.

* * * * *